US006092886A

United States Patent [19]

Hosono

[11] Patent Number: 6,092,886

[45] Date of Patent: Jul. 25, 2000

[54] INK JET RECORDING APPARATUS

[75] Inventor: Satoru Hosono, Nagano, Japan

[73] Assignee: Seiko Epson Corporation, Tokyo, Japan

[21] Appl. No.: 08/888,327

[22] Filed: Jul. 3, 1997

[30] Foreign Application Priority Data

Jul. 5, 1996 [JP] Japan ..... 8-195624

[51] Int. Cl.[7] ..... B41J 2/045

[52] U.S. Cl. ..... 347/10; 347/11; 347/12

[58] Field of Search ..... 347/10–11, 14, 347/68, 70

[56] References Cited

U.S. PATENT DOCUMENTS

| | | | |
|---|---|---|---|
| 4,593,291 | 6/1986 | Howkins | 347/68 |
| 5,202,659 | 4/1993 | DeBonte et al. | 347/11 |
| 5,552,809 | 9/1996 | Hosono et al. | 347/10 |

FOREIGN PATENT DOCUMENTS

| | | | |
|---|---|---|---|
| 0541129 | 5/1993 | European Pat. Off. . | |
| 0596530 | 5/1994 | European Pat. Off. . | |
| 0700783 | 3/1996 | European Pat. Off. . | |
| 0728583 | 8/1996 | European Pat. Off. . | |
| WO 95/16568 | 6/1995 | WIPO | B41J 2/045 |

*Primary Examiner*—John Barlow
*Assistant Examiner*—Craig A. Hallacher
*Attorney, Agent, or Firm*—Sughrue, Mion, Zinn, Macpeak & Seas, PLLC

[57] ABSTRACT

An ink jet print head operates so as to prevent the undesired production of an ink droplet that otherwise would result from a vibration of one piezoelectric vibrator propagating to an adjacent piezoelectric vibrator to which a drive signal is not presently applied. In particular, a first signal expands a pressure producing chamber, a second signal keeps the chamber expanded, and a third signal is contracts the chamber and jets the an ink droplet. A duration Pwh of the second signal is $0.7\times Ta(n+½)\leqq Pwh\leqq 1.3\times Ta(n+½)$ when the Helmholtz resonance frequency ranges from 70 to 100 kHz, and is $0.8\times Ta(n+½)\leqq Pwh\leqq 1.2\times Ta(n+½)$ when the Helmholtz resonance frequency is 100 kHz or more. An ink droplet is jetted out by applying the third signal and thereby contracting the pressure producing chamber during the aforementioned time periods. Therefore, even if the first signal has been applied, and a vibration caused by the expansion has thereafter propagated to an adjacent piezoelectric vibrator, an ink droplet can be jetted out by contracting the pressure producing chamber at a timing that induces a vibration whose phase is opposite to that of the vibration caused by the expansion. Hence, the vibration of the adjacent piezoelectric vibrator can effectively be cancelled.

13 Claims, 9 Drawing Sheets

INK JET RECORDING APPARATUS

BACKGROUND OF THE INVENTION

The present invention relates to technology for driving an ink jet recording head in which a piezoelectric vibrator is used as an actuator.

Vertical mode piezoelectric vibrators and flexural vibration mode piezoelectric vibrators are examples of high-speed drive actuators used in ink jet recording heads. High-speed drive actuators are formed, in part, of an elastic plate. Such actuators are used in ink jet recording heads of the type described below.

Such ink jet recording heads include piezoelectric vibrators, pressure producing chambers, and nozzle openings. In particular, an ink jet recording head may draw ink from an ink source by using a sucking force. The ink so drawn enters a pressure producing chamber. The pressure producing chamber communicates with a nozzle opening. The pressure producing chamber can be expanded and contracted. The expansion and contraction of the pressure producing chamber is performed by a piezoelectric vibrator.

The expansion and contraction of the pressure producing chamber by the piezoelectric vibrator is what causes the sucking force which draws ink into the pressure producing chamber. The expansion and contraction of the pressure producing chamber by the piezoelectric vibrator is also what causes the expulsion of a desired ink droplet through the nozzle opening.

A vertical mode piezoelectric vibrator is formed by laminating a piezoelectric material and a conductive layer one upon another. A flexural mode piezoelectric vibrator is formed by arranging a piezoelectric vibrating thin layer on a surface of a vibrating plate. Such a thin film may be formed, for example, by sputtering or vapor deposition.

Such a piezoelectric vibrator has only a small area in contact with the vibrating plate, and is capable of being driven at high speed. This sort of piezoelectric vibrator is advantageous in that it permits the high density arrangement of the pressure producing chambers. As a result, high-resolution and high-speed printing can be achieved.

The high density arrangement of the pressure producing chambers is not, however, without its problems. One problem involves unwanted vibrations.

To explain, it is important first to define some terms which will be used throughout this description. These terms are "desired pressure producing chamber", "desired piezoelectric vibrator", "physically adjacent chamber", "physically adjacent piezoelectric vibrator", "undesired adjacent pressure producing chamber", and "undesired adjacent piezoelectric vibrator".

For the purposes of this description, the term "desired pressure producing chamber" refers to a pressure producing chamber that presently should be driven to produce an ink droplet. Whether a pressure producing chamber presently should be driven depends, normally, on the print data. The piezoelectric vibrator of a desired pressure producing chamber shall be referred to as a "desired piezoelectric vibrator".

For the purposes of this description, the term "physically adjacent chamber" means a pressure producing chamber that is physically adjacent to another pressure producing chamber. Whether a pressure producing chamber is a physically adjacent chamber of another pressure producing chamber depends on the physical layout of the pressure producing chambers. The piezoelectric vibrator of a physically adjacent vibrator shall be referred to as a "physically adjacent piezoelectric vibrator".

In this description, the term "undesired adjacent pressure producing chamber" refers to a physically adjacent chamber of a desired pressure producing chamber and, in particular, one which presently should not be driven to produce an ink droplet. Thus, a undesired adjacent pressure producing chamber not only is a physically adjacent chamber, but also is a chamber from which no present jetting of an ink-droplet is desirable. Whether a physically adjacent chamber presently should be driven depends, normally, on the print data. The piezoelectric vibrator of an undesired adjacent pressure producing chamber shall be referred to as an "undesired adjacent piezoelectric vibrator".

As mentioned above, one problem with an ink jet recording head that has pressure producing chambers arranged at a high density is that the vibration of a desired pressure producing chamber may propagate as far as an undesired adjacent pressure producing chamber. The vibrations thus propagate may cause an ink droplet to be jetted from the undesired adjacent pressure producing chamber. This jetting of an ink droplet from an undesired adjacent pressure producing chamber is known as the crosstalk phenomenon. The crosstalk phenomenon is a problem because it results in the jetting of an ink droplet independently of the application of a drive signal. In other words, even though the undesired adjacent piezoelectric vibrator of the undesired adjacent pressure producing chamber is not driven, an ink droplet may nevertheless be jetted.

To meet the need for high-density printing, an ink jet recording head not only might provide a high density arrangement of pressure producing chambers, but also might use a smaller amount of ink for forming its ink droplets. Such a printer, to provide proper printed output, must take care of the crosstalk phenomenon. The crosstalk phenomenon problem occurs especially easily in such an ink jet recording head, however, because the compliance of a pressure producing chamber is controlled to be a small value.

A more detailed explanation of this problem is now made with reference to FIGS. 10 and 11. In FIG. 10, piezoelectric vibrators D and F are, at the same time, desired piezoelectric vibrators. In other words, piezoelectric vibrators D and F are both presently to be driven in accordance with the print data so that ink droplets will be jetted from the pressure producing chambers to which piezoelectric vibrators D and F correspond. The pressure producing chambers to which piezoelectric vibrators D and F correspond thus are desired pressure producing chambers. Both piezoelectric vibrators D and F have in common, as an undesired adjacent piezoelectric vibrator, piezoelectric vibrator E. In other words, piezoelectric vibrator E is not presently to be driven, and no ink droplet from the pressure producing chamber to which piezoelectric vibrator E corresponds is desired. Thus, the pressure producing chamber to which piezoelectric vibrator E corresponds is an undesired adjacent pressure producing chamber.

FIG. 10 thus shows a vibrating unit with a plurality of piezoelectric vibrators B to G. Piezoelectric vibrators D and F are presently desired piezoelectric vibrators, and piezoelectric vibrator E, with respect to each of piezoelectric vibrators D and F, is an undesired adjacent piezoelectric vibrator. Piezoelectric vibrators B to G are fixed to a highly rigid fixing board A. These piezoelectric vibrators are fixed to the fixing board so that each piezoelectric vibrator corresponds to a respective pressure producing chamber. In other words, each of the plurality of piezoelectric vibrators is operationally disposed with respect to a corresponding pressure producing chamber.

Piezoelectric vibrators D and F are presently to be driven by drive signals so that the aforementioned expansion and contraction of their respective pressure producing chambers may be accomplished. In particular, the piezoelectric vibrators may be driven by drive signals that have a trapezoidal shape as shown in FIG. 11(I). Drive signals having the general shape as shown in FIG. 11(I) may be referred to as trapezoidal drive signals. A first part of the trapezoidal drive signal in FIG. 11(I) is characterized by a rising slope. The effect of this first part of the trapezoidal drive signal may be referred to as "charging". A second part is characterized by a level signal. The effect of this part of the trapezoidal drive signal may be referred to as "holding". A third part of the drive signal is characterized by a falling slope, and the corresponding effect may be referred to as "discharging".

When trapezoidal drive signals such as that shown in FIG. 11(I) are applied to desired piezoelectric vibrators D and F, but not applied to undesired adjacent piezoelectric vibrator E, the corresponding pressure producing chambers behave according to the following description.

Reference is now made to FIG. 11(II). This figure shows the volume of a pressure producing chamber. The horizontal line is a reference line which represents the volume of the pressure producing chamber when the pressure producing chamber is neither expanded nor contracted. The data points below the horizontal reference line represent contraction. The further from the horizontal reference line a data point is, the more the pressure producing chamber is contracted. Likewise, data points above the horizontal reference line represent expansion of the pressure producing chamber. As will be appreciated, the wavy line in FIG. 11(II) represents the expansion and contraction of a pressure producing chamber over time.

For convenience, the following description may state that a piezoelectric vibrator contracts or expands. This is merely a shorthand way of stating that the piezoelectric vibrator is driven in a certain manner which causes the corresponding pressure producing chamber to experience contraction or expansion.

During the first part of the trapezoidal drive signal (i.e., during charging), the piezoelectric vibrators D and F contract as shown in FIG. 11(II). During the second part of the trapezoidal drive signal (i.e., during holding), the drive signal is held at a predetermined voltage. When charging stops and holding begins, natural vibrations are caused. In other words, when the piezoelectric vibrators stop contracting and are held, natural vibrations result. These natural vibrations may be referred to as free vibrations or as first natural vibrations.

Holding of piezoelectric vibrators D and F lasts for a predetermined period of time. In order to jet ink droplets after a predetermined time has elapsed, the charges stored in the piezoelectric vibrators D and F are discharged so as to expand these piezoelectric vibrators. After the ink droplets have been jetted out, the piezoelectric vibrators D and F start vibrating naturally again. The natural vibrations caused after the jetting of the ink droplets may be referred to as latter free vibrations or as second natural vibrations.

On the other hand, the undesired adjacent piezoelectric vibrator E, to which no drive signal has been applied, receives vibrations through the fixing board A. The undesired adjacent piezoelectric vibrator E receives not only the free vibrations, but also the latter free vibrations created with the jetting of the ink droplets from desired piezoelectric vibrators D and F.

As a result, the undesired adjacent piezoelectric vibrator E has the amplitude of a vibration thereof amplified as shown in FIG. 11 (III) due to interference between the vibrations at the time of charging and the vibrations after the ink droplets have been jetted out. The amplitude of the vibration of the piezoelectric vibrator E caused by the propagation is in the order of 10% of the maximum amplitude of the vibrations of the desired piezoelectric vibrators D and F. However, if the vibration of the piezoelectric vibrator E lasts for a plurality of cycles, e.g., for three cycles or more, then the vibration of the meniscus of the nozzle opening corresponding to the piezoelectric vibrator E is amplified, which in turn causes an ink droplet undesirably to be jetted out.

SUMMARY OF THE INVENTION

The present invention has been made in view of the aforementioned problems. The object of the present invention is therefore to provide a novel ink jet recording apparatus that can implement high-quality and high-density printing by preventing crosstalk caused by vibrations to a possible extent, the vibrations propagating through a fixing board to which piezoelectric vibrators are fixed.

In order to overcome these problems, the present invention is applied to an ink jet recording apparatus that includes an ink jet recording head having a nozzle opening, a pressure producing chamber communicating with a common ink chamber through an ink supply port and having a Helmholtz resonance frequency; a piezoelectric vibrator having a natural vibration cycle Ta for expanding and contracting the pressure producing chamber; and drive signal generating means for not only outputting a first signal for expanding the pressure producing chamber, a second signal for keeping the pressure producing chamber expanded, and a third signal for jetting an ink droplet out of the nozzle opening by contracting the expanded pressure producing chamber, but also having a duration Pwh of the second signal set to:

$$0.7\times Ta(n+½)\leqq \mathrm{Pwh}\leqq 1.3\times Ta(n+½)$$

when the Helmholtz resonance frequency ranges from 70 to 100 kHz, and to $$0.8\times Ta(n+½)\leqq Pwh\leqq 1.2\times Ta(n+½)$$

(where n is an integer) when the Helmholtz resonance frequency is 100 kHz or more.

Even if a first signal for expanding a pressure producing chamber has been applied and a vibration caused by the expansion has thereafter propagated to an adjacent piezoelectric vibrator to which a drive signal has not been applied, an ink droplet can be jetted out by contracting the pressure producing chamber at such a timing as to induce a vibration whose phase is opposite to the vibration caused by the expansion. Hence, crosstalk caused by the vibration propagating through the fixing board can be prevented.

DETAILED DESCRIPTION OF THE PREFERRED EMBODIMENTS

Figure 1:
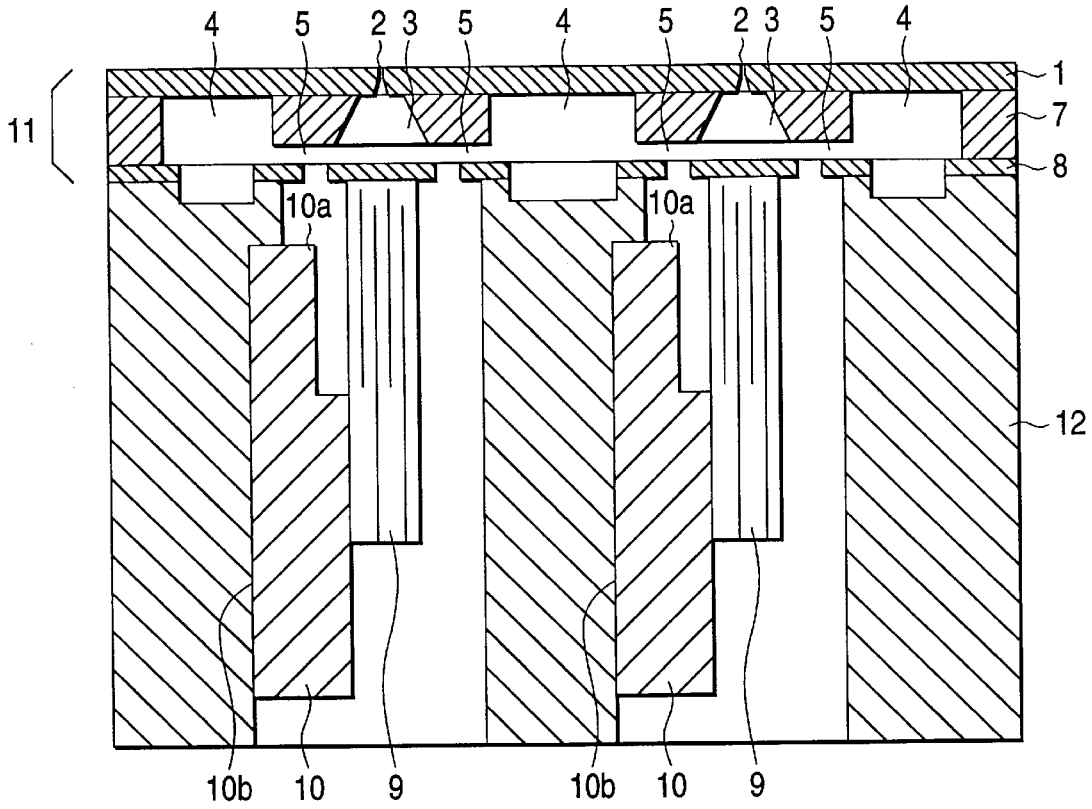
FIG. 1 is a sectional view showing an embodiment of an ink jet recording head used in an ink jet recording apparatus of the present invention.

Details of the present invention will now be described with reference to the embodiments shown in the drawings.

FIG. 1 is a diagram showing an embodiment of an ink jet recording head used in the present invention. In FIG. 1, reference numeral 1 denotes a nozzle plate having nozzle openings 2 bored therein; 7, a passage forming plate; and 8, an elastic plate. An ink passage unit 11 is formed by sealing both surfaces of the passage forming plate 7 with the nozzle plate 1 and the elastic plate 8.

The ink passage unit 11 has pressure producing chambers 3, common ink chambers 4, and ink supply ports for connecting both chambers 3, 4 to each other. When a drive signal has been applied to a piezoelectric vibrator 9 to be described later and the piezoelectric vibrator 9 has therefore contracted, the ink passage unit 11 sucks ink to the corresponding pressure producing chamber 3 from the corresponding common ink chamber 4 through the corresponding ink supply port 5, and when the piezoelectric vibrator 9 has expanded, the ink passage unit 11 jets an ink droplet out.

Reference numeral 9 denotes the piezoelectric vibrator, which is formed by laminating a piezoelectric material and a conductive material one upon another in parallel with a direction of expansion thereof. The piezoelectric vibrator 9 is of a so-called vertical vibration mode that when charged, contracts at right angles to the conductive layer laminating direction, and when the charged condition changes to a discharged condition, expands at right angles to the conductive layers. The piezoelectric vibrators 9 are assembled into a vibrator unit with the rear ends thereof fixed at a predetermined pitch to a fixing board 10 that is made of a highly rigid material.

The vibrator unit is fixed to a frame 12 not only with the end of each piezoelectric vibrator 9 brought into contact with the elastic plate 8 that forms the pressure producing chambers 3 but also with the front end 10*a* and the side end 10*b* of the fixing board 10 fixed to the frame 12. By fixing the fixing board 10 to the frame 12 at a plurality of surfaces 10*a*, 10*b*, propagation of the vibration of a piezoelectric vibrator to which a drive signal has been applied to other piezoelectric vibrators is suppressed to a possible extent, so that crosstalk can be prevented.

By the way, in the thus constructed ink jet recording head, the Helmholtz resonance frequency FH of a pressure producing chamber 3 is given as follows when it is assumed that: the fluid compliance attributable to the compressibility of ink in the pressure producing chamber 3 is Ci; the rigidity compliance of the materials of which the elastic plate 8, the nozzle plate 2, and the like forming the pressure producing chamber 3 are made is Cv; the inertance of the nozzle opening 2 is Mn; and the inertance of the ink supply port 5 is Ms.

$$FH=\tfrac{1}{2}\pi\times\sqrt{\{(Mn+Ms)/(Ci+Cv)(Mn+Ms)\}}$$

It may be noted the fluid compliance Ci can be given as follows when it is assumed that the volume of the pressure producing chamber 3 is V; the density of the ink is ρ; and the sound velocity through the ink is c.

$$Ci=V/\rho c^2$$

Further, the rigidity compliance Cv of the pressure producing chamber 3 coincides with the static deformation rate of the pressure producing chamber 3 when a unit pressure is applied to the pressure producing chamber 3.

Specifically, in the case of a pressure producing chamber 3 having a length ranging from 0.5 to 2 mm, a width ranging from 0.1 to 0.2 mm, and a depth ranging from 0.05 to 0.3 mm, the Helmholtz resonance frequency FH ranges from about 70 kHz to 200 kHz.

Figure 2:
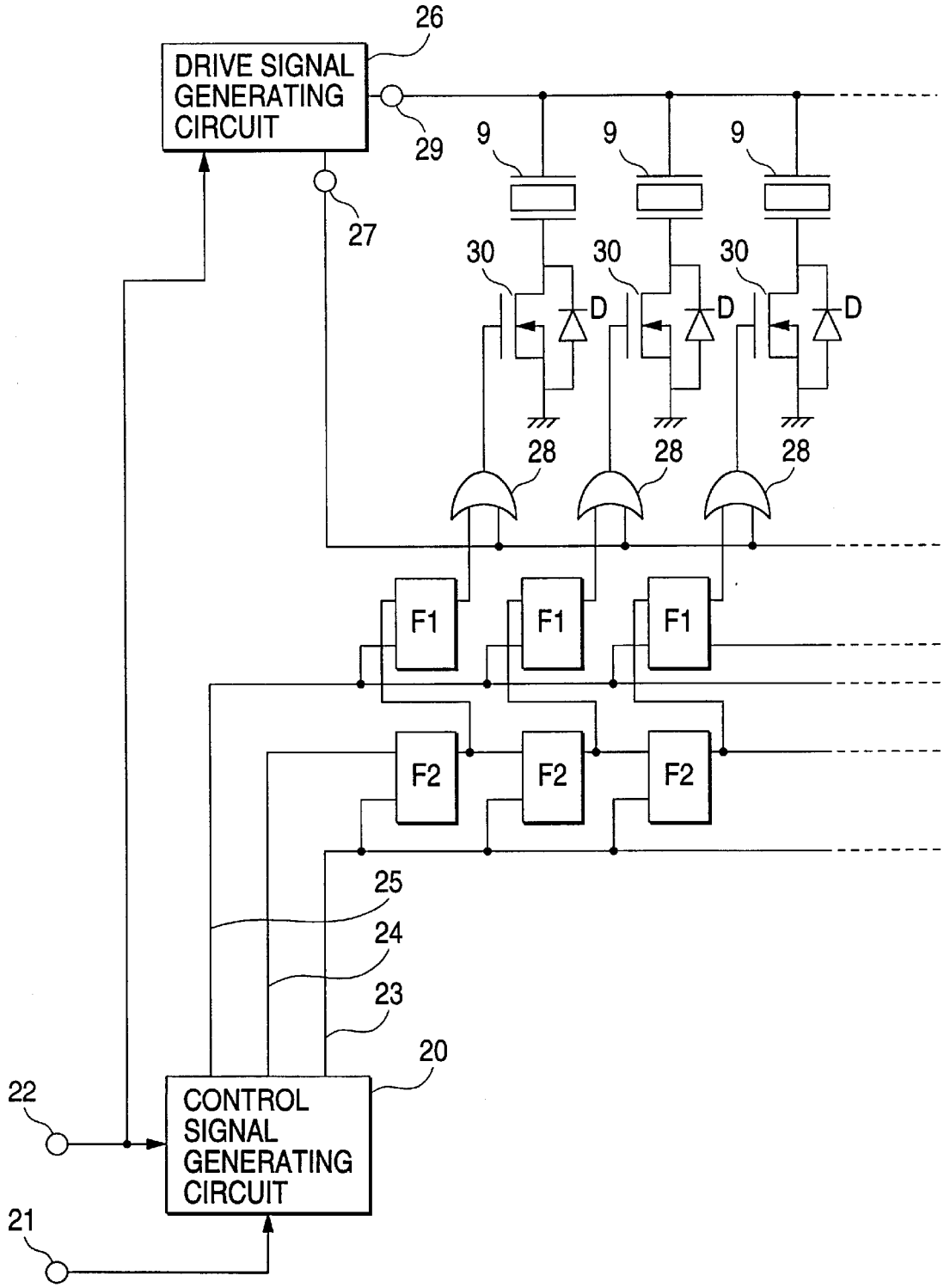
FIG. 2 is a block diagram showing an embodiment of an ink jet recording apparatus of the present invention.

FIG. 2 shows an embodiment of a drive circuit for driving the aforementioned ink jet recording head. In FIG. 2, reference numeral 20 denotes a control signal generating circuit, which has input terminals 21, 22 and output terminals 23, 24, 25. A print signal and a timing signal that generate print data are inputted to the terminals 21, 22 from an external device. A shift clock signal, a print signal, and a latch signal are outputted from the output terminals 23, 24, 25.

Reference numeral 26 denotes a drive signal generating circuit, which outputs drive signals that drive piezoelectric vibrators 9 based on timing signals received at the terminal 22 from the external device.

Reference characters F1 denote flip-flops that form latch circuits. Reference characters F2 denote flip-flops that form shift registers. It is so designed that print signals outputted so as to correspond to the respective piezoelectric vibrators 9 from the flip-flops F2 are latched at the flip-flops F1; and then selected signals are outputted to switching transistors 30 through OR gates 28.

Figure 3:
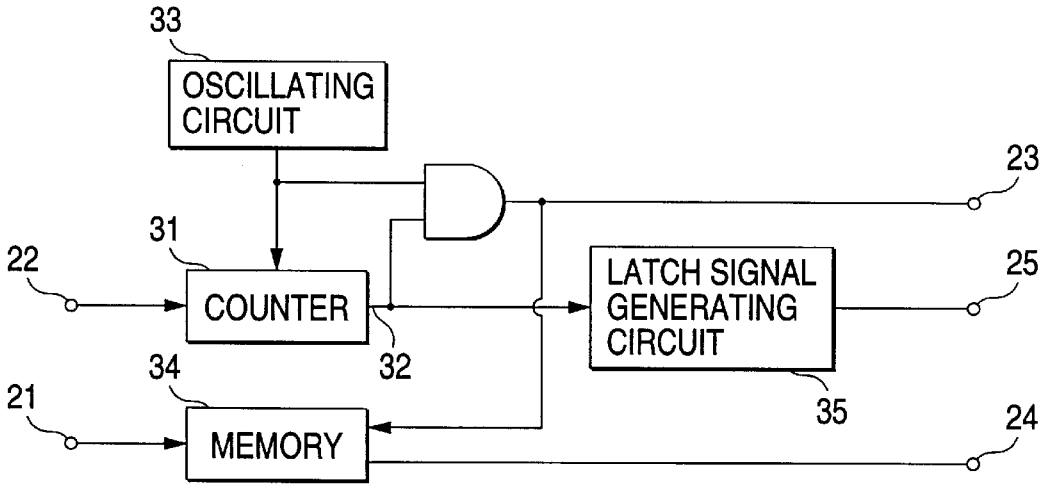
FIG. 3 is a block diagram showing an embodiment of a control signal generating circuit in the aforementioned apparatus.

FIG. 3 shows an embodiment of the aforementioned control signal generating circuit 20. In FIG. 3, reference numeral 31 denotes a counter, which is initialized at the rise of a timing signal (FIG. 5 (I)) inputted from the terminal 22, and stops counting by outputting a low-level carry signal at the time of having counted clock signals from an oscillating circuit 33 coinciding with the number of piezoelectric vibrators 9 connected to an output terminal 29 of the drive signal generating circuit 26. The carry signal of the counter 31 is used to output a shift clock signal to the terminal 23 after having been ANDed with the clock signals from the oscillating circuit 33 through an AND gate.

Further, reference numeral 34 denotes a memory that stores print data consisting of a number of bits coinciding with the number of piezoelectric vibrators 9, the print data being inputted from the terminal 21. The memory 34 also has the function of serially outputting the stored print data on a single bit basis to the terminal 24 in synchronism with a signal from the AND gate.

Figure 5:
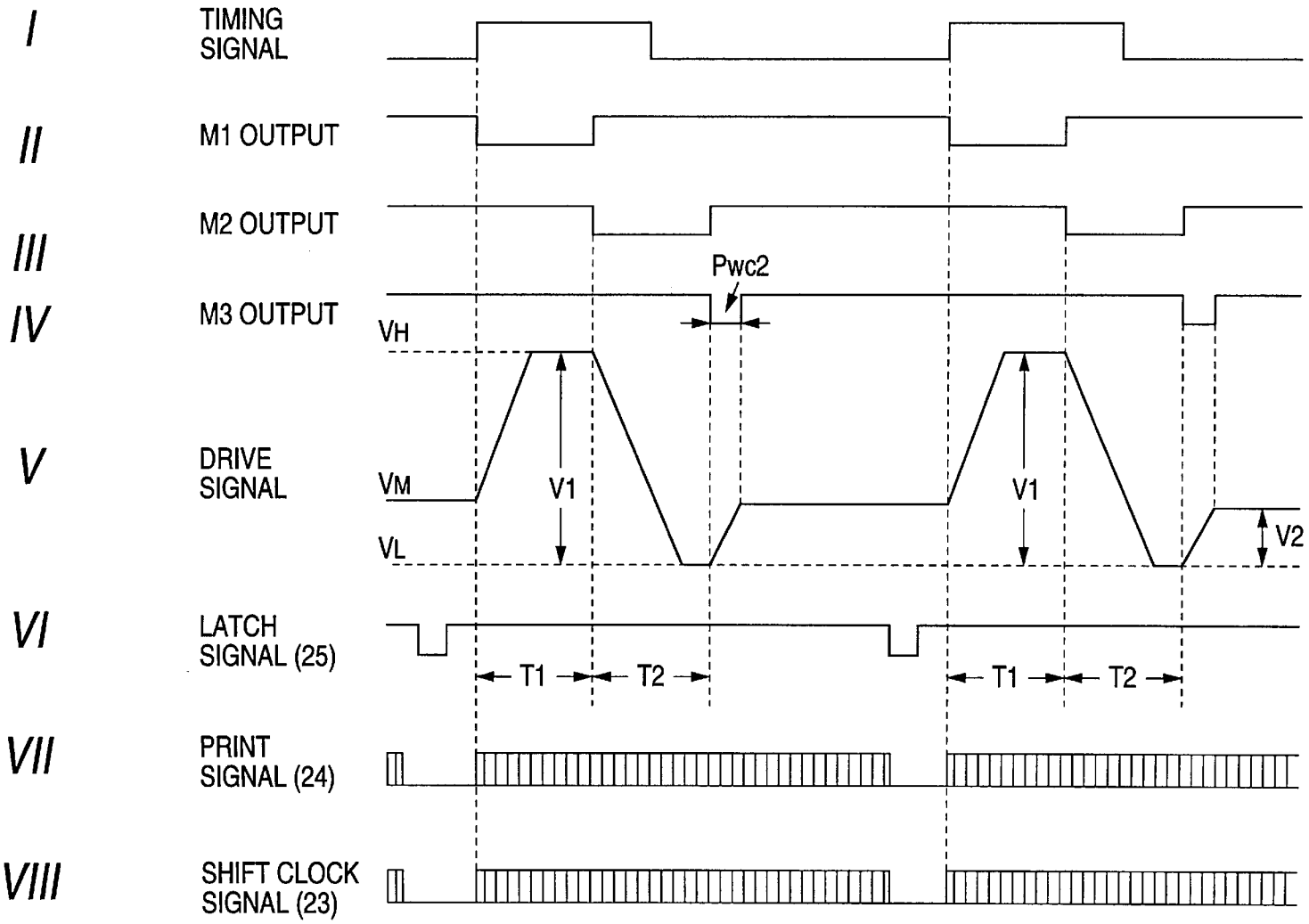
FIG. 5 includes waveform diagrams (I) to (VIII) showing an operation of the aforementioned apparatus.
Figure 6:
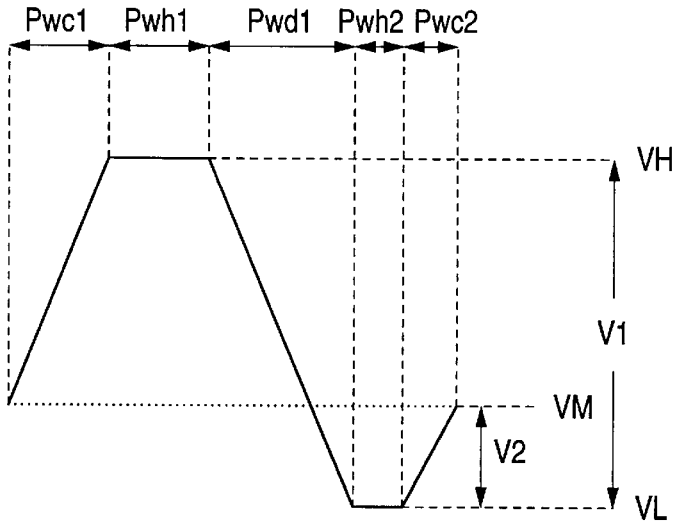
FIG. 6 is a diagram showing parameters defining a drive signal.

The print signal (FIG. 5 (VII)) serially transferred from the terminal 24 is transformed into selected signals for the switching transistors 30 at a next print cycle, and latched at the flip-flops F1 that form the aforementioned shift registers by the shift clock signal (FIG. 5 (VIII)) outputted from the terminal 23. It may be noted that a latch signal is outputted from a latch signal generating circuit 35 in synchronism with the fall of the aforementioned carry signal. The output timing of the latch signal is within a time period in which a drive signal maintains an intermediate potential VM, the time period being described later.

Figure 4:
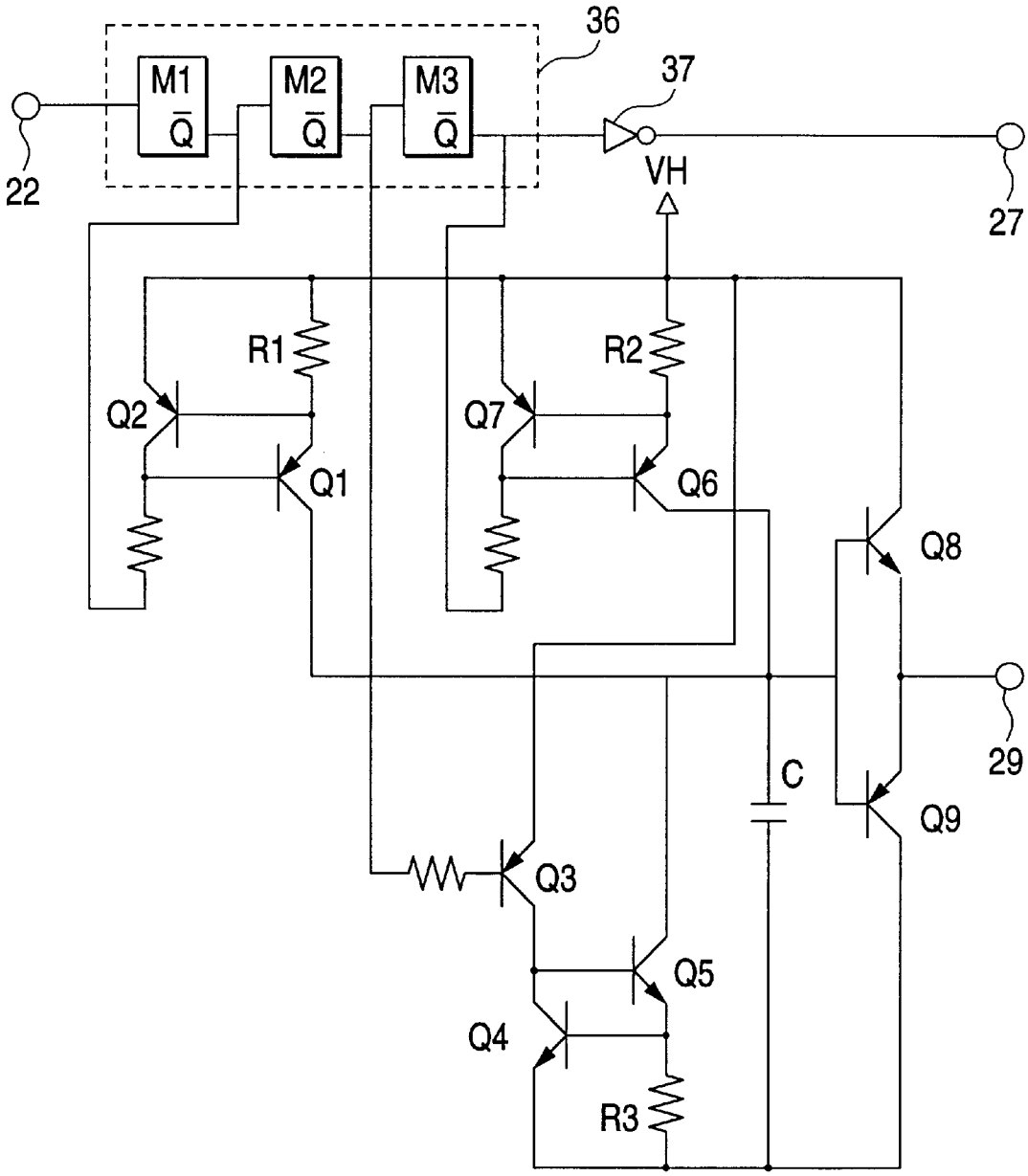
FIG. 4 is a circuit diagram showing an embodiment of a drive signal generating circuit in the aforementioned apparatus.

FIG. 4 shows an embodiment of the aforementioned drive signal generating circuit 26. In FIG. 4, reference numeral 36 denotes a timing control circuit, which has one-shot multivibrators M1, M2, M3 that are connected to one another in tandem. Pulse widths PW1, PW2, PW3 (FIGS. 5 (II), (III), (IV)) are set to the one-shot multivibrators M1, M2, M3 for defining a sum T1=(Pwc1+Pwh1) of a first charge time (Pwc1) and a first hold time (Pwh1), a sum T2=(Pwd1+Pwh2) of a discharge time (Pwd1) and a second hold time (Pwh2), and a second charge time Pwc2, respectively.

Pulses outputted from the one-shot multivibrators M1, M2, M3 control transistors Q2 and Q3 so that the transistors Q2 and Q3 are turned on and off at the rise and fall thereof. That is, the transistor Q2 is charged; the transistor Q3 is discharged; and the transistor Q2 is secondarily charged.

By the way, when a drive signal has been applied to a piezoelectric vibrator 9 and the corresponding pressure producing chamber 3 is therefore expanded by the displacement of such piezoelectric vibrator 9, the magnitude of a vibration of a piezoelectric vibrator 9 corresponding to a pressure producing chamber 3 adjacent to the expanded pressure producing chamber 3, the vibration being caused by the displacement of the piezoelectric vibrator 9 to which the drive signal has been applied, depends greatly on the structure and the like of the recording head.

That is, in a recording head having highly rigid pressure producing chambers 3 whose Helmholtz resonance frequency exceeds 100 kHz, the degree of pressure fluctuation per unit time within a pressure producing chamber 3 with respect to a displacement of a corresponding piezoelectric vibrator is high. In a relatively flexibly designed recording head having the Helmholtz resonance frequency ranging from 70 to 100 kHz, the degree of pressure fluctuation per unit time within a pressure producing chamber 3 with respect to a displacement of a corresponding piezoelectric vibrator is relatively low.

Thus, the degree of pressure fluctuation per unit time within a pressure producing chamber 3 with respect to a displacement of a corresponding piezoelectric vibrator 9 differs from one recording head to another. In driving a recording head whose Helmholtz resonance frequency exceeds 100 kHz, a time interval during which the second drive signal that keeps the pressure producing chamber 3 expanded is applied, i.e., the hold time Pwh is set in such a manner that the amplitude of a vibration of a piezoelectric vibrator to which a drive signal has not been applied is within time regions (the regions indicated by hatching) not exceeding a first allowable level L1 shown in FIG. 7, i.e., $0.8\times Ta(n+½)\leqq Pwh\leqq 1.2\times Ta(n+½)$.

Further, in driving the later recording head, the second drive signal for keeping a pressure producing chamber 3 expanded is set in such a manner that the amplitude of a vibration of a piezoelectric vibrator to which a drive signal has not been applied is within time regions not exceeding a second allowable level L2 shown in FIG. 7, i.e., $0.7\times Ta(n+½)\leqq Pwh\leqq 1.3\times Ta(n+½)$.

The degree of pressure fluctuation per unit time becomes low if the Helmholtz resonance frequency is 70 kHz or less. Therefore, it has been verified from experiments that it is not necessary to set the second drive signal for keeping a pressure producing chamber 3 expanded to values as defined in the aforementioned ranges.

An operation of the thus constructed apparatus will be outlined next.

When a timing signal is inputted to the terminal 22 from the external device, the one-shot multivibrator M1 that forms the timing control circuit 36 outputs a pulse signal (FIG. 5 (II)) having the preset pulse width PW1 (Pwc1+Pwh1). When the transistor Q1 is turned on by this pulse signal, a capacitor C that has initially been charged to a potential VM is charged with a current Ic1 that is determined by the transistor Q2 and a resistor R1. When the terminal voltage of the capacitor C equals a power supply voltage VH as a result of the charging operation, the charging operation is automatically stopped, and this voltage VH is thereafter held until the capacitor C is discharged.

When the one-shot multivibrator M1 reverses after the time T1=(Pwc1+Pwh1) equivalent to the pulse width PW1 of the one-shot multivibrator M1 has elapsed, not only the transistor Q1 is turned off, but also a pulse signal (FIG. 5 (III)) having the pulse width PW2 is outputted from the one-shot multivibrator M2, so that the transistor Q3 is turned on and the capacitor C is therefore discharged. This discharging operation is held with a predetermined current Id that is determined by a transistor Q4 and a resistor R3 until the terminal voltage of the capacitor C nearly reaches a voltage VL.

When the one-shot multivibrator M2 reverses after the time T2=(Pwd1+Pwh2) equivalent to the pulse width PW2 of the one-shot multivibrator M2 has elapsed, a pulse signal (FIG. 5 (IV)) having the pulse width PW3 is outputted from the one-shot multivibrator M3, so that a transistor Q6 is turned on. As a result, the capacitor C is charged again with a predetermined current Ic2, and the capacitor voltage reaches the intermediate potential VM that is determined by the time (Pwc2) equivalent to the pulse width PW3 of the one-shot multivibrator M3. The capacitor C charging operation ends at the potential VM, and this capacitor voltage VM is thereafter held until a timing signal is inputted again.

As a result of such charging and discharging operations, generated is such a drive signal that the capacitor voltage increases from the intermediate potential VM to the voltage VH at a predetermined gradient; the voltage VH is held for a predetermined time Pwh1; the voltage VH is then decreased to the voltage VL at a predetermined gradient; the voltage VL is held for a predetermined time Pwh2; and the voltage VL is increased to the intermediate voltage VM again as shown in FIG. 5.

The operation of the thus constructed apparatus will be described next in relation to an ink droplet jetting operation.

As described above, the control signal generating circuit 20 transfers selected signals of the switching transistors 30 during a previous print cycle, so that the control signal generating circuit 20 causes these selected signals to be latched by the flip-flops F1 while all the piezoelectric vibrators 9 are being charged to the intermediate potential VM. A timing signal is thereafter inputted and a drive signal shown in FIG. 5 (V) has the capacitor voltage increased from the intermediate potential VM to the voltage VH, so that a corresponding piezoelectric vibrator 9 is charged.

As a result of this charging operation, the piezoelectric vibrator 9 contracts at a predetermined speed to expand the corresponding pressure producing chamber 3. When the pressure producing chamber 3 has expanded, the ink within the corresponding common ink chamber 4 flows into the pressure producing chamber 3 through the corresponding ink supply port 5, and at the same time, the meniscus of the corresponding nozzle opening 2 is sucked toward the pressure reducing chamber 3. When the drive signal has reached the voltage VH, the voltage VH is held for the time Pwh1. With the charged voltage VH maintained, the piezoelectric vibrator 9 starts free vibration based on the natural vibration cycle thereof. This free vibration propagates to other adjacent piezoelectric vibrators 9 through the fixing board 10, so that a piezoelectric vibrator 9 to which a drive signal has not been applied is also caused to vibrate.

Figure 7:
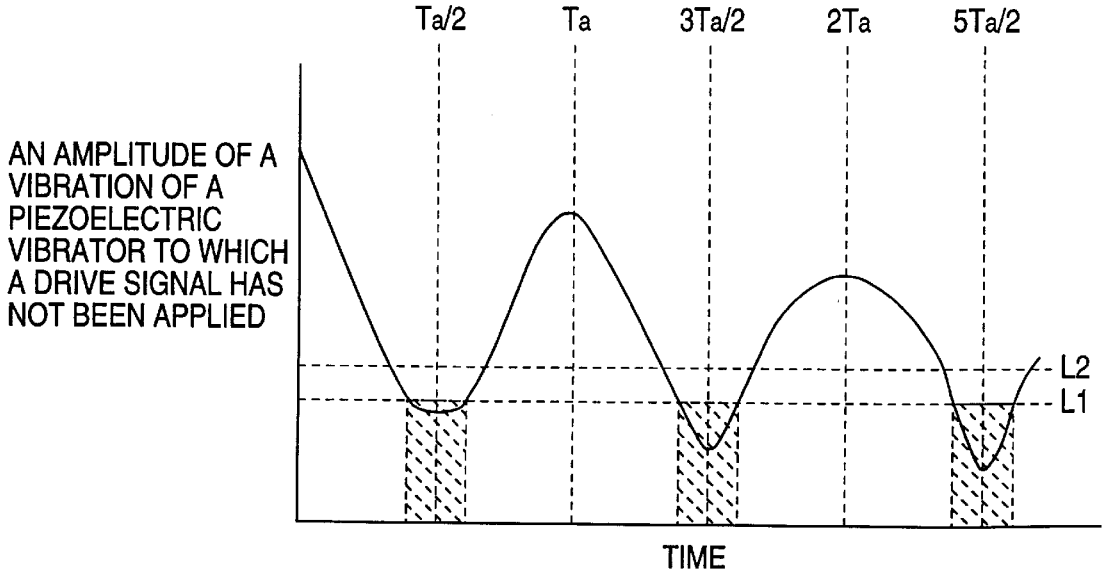
FIG. 7 is a diagram showing a duration of a second signal for preventing crosstalk.
Figure 8:
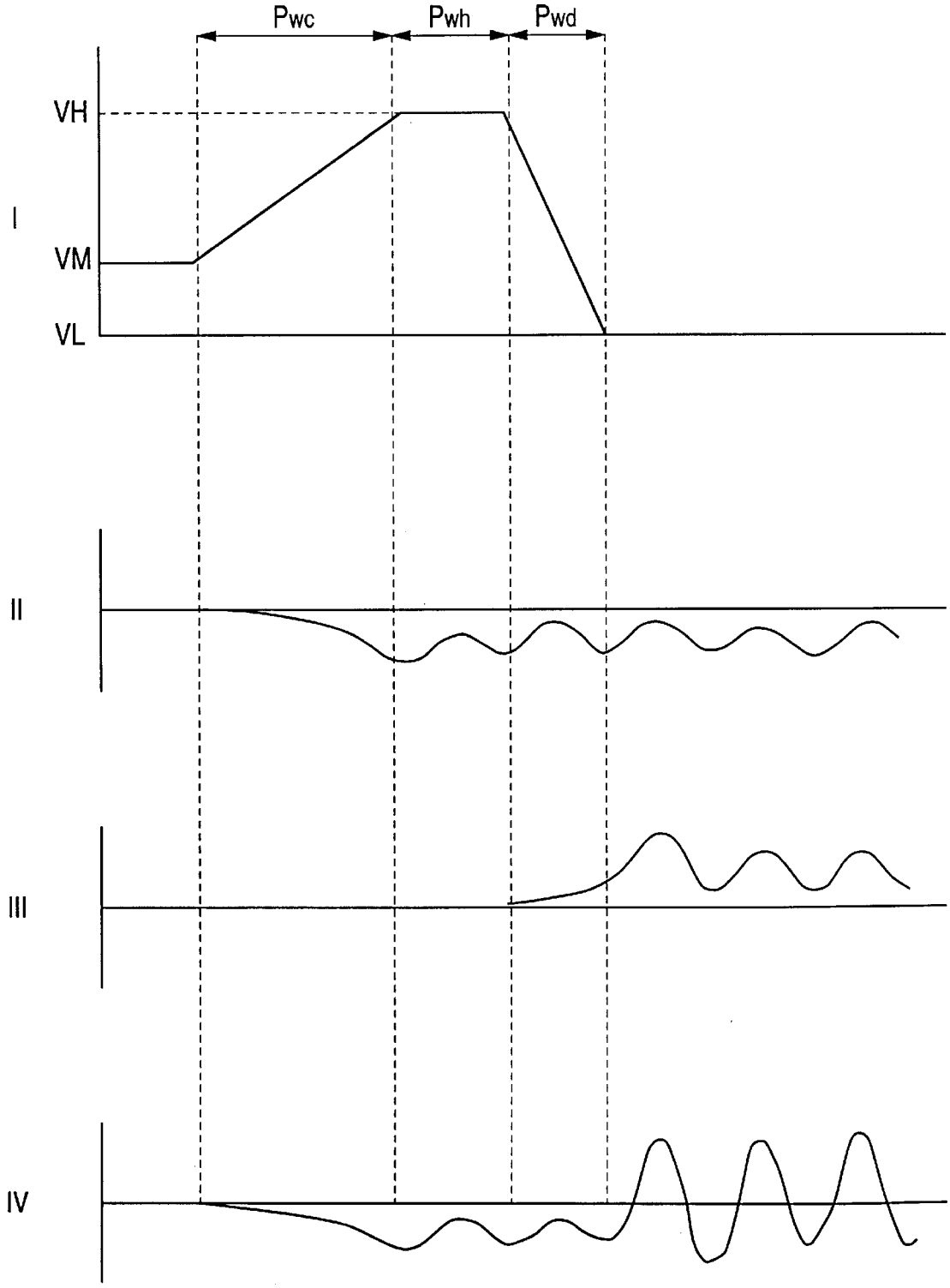
FIG. 8 includes: a waveform diagram (I) showing a drive signal; a waveform diagram (II) showing a vibration of a piezoelectric vibrator to which a drive signal has not been applied when only a first signal has been applied to an adjacent piezoelectric vibrator; a waveform diagram (III) showing a vibration of a piezoelectric vibrator to which a drive signal has not been applied when only a third signal has been applied to an adjacent piezoelectric vibrator; and a waveform diagram (IV) showing a vibration of a piezoelectric vibrator to which a drive signal has not been applied when only a drive signal has been applied to an adjacent piezoelectric vibrator.

The time Pwh1 is set to the regions indicated by hatching in FIG. 7, i.e., to a time length ranging from 0.8 to 1.2 before and after each time point (Ta/2, 3Ta/2, 5Ta/2 . . . ). Therefore, it is at these timings that the one-shot multivibrator M1 reverses; a signal is outputted from the one-shot multivibrator M2; and a third drive signal for contracting the pressure producing chamber 3 is applied to the piezoelectric vibrator 9 of the pressure producing chamber 3 that jets an ink droplet.

Therefore, the cycle of a vibration that propagates through the fixing board 10 to a piezoelectric vibrator 9 to which a drive signal has not been applied is shifted half a cycle, which in turn reduces the amplitude of a vibration of the piezoelectric vibrator 9 to which a drive signal has not been applied and hence prevents an ink droplet from being jetted out of the nozzle opening corresponding to the piezoelectric vibrator 9 to which a drive signal has not been applied.

As a result, the charges stored in the piezoelectric vibrators 9 that have been charged to the voltage VH are discharged through diodes D, which in turn causes the piezoelectric vibrators 9 to expand to thereby contract the corresponding pressure producing chambers 3. As a result of the contraction of the pressure producing chambers 3, pressure is applied to the ink and the pressured ink is then jetted out of the corresponding nozzle openings 2 in the form of ink droplets.

When the ink droplet has been completely jetted out, the piezoelectric vibrator 9 starts free vibration at the natural vibration cycle thereof. This free vibration propagates through the fixing board 10 to an adjacent piezoelectric vibrator 9 to which a drive signal has not been applied. The piezoelectric vibrator 9 to which a drive signal has not been applied receives, in addition to the free vibration caused when the pressure producing chamber has expanded, the propagation of a vibration caused by the free vibration of the piezoelectric vibrator 9 to which the drive signal has been applied, the latter free vibration being caused after the ink droplet has been jetted. Therefore, the amplitude of the vibration received by the piezoelectric vibrator 9 to which a drive signal has not been applied is amplified. However, at this point of time, the amplitude of the vibration of the piezoelectric vibrator 9 to which a drive signal has not been applied takes a value too small to jet an ink droplet. Therefore, even if a vibration equivalent to a plurality of cycles lasts, such vibration is not large enough to jet an ink droplet out of a nozzle opening.

A timing at which the amplitude of a vibration of the piezoelectric vibrator 9 to which a drive signal has not been applied, the vibration being caused by a free vibration caused by the contraction of the piezoelectric vibrator 9 for jetting an ink droplet, i.e., caused by a free vibration after the pressure producing chamber 3 has been expanded is minimized comes at $$Ta/2,\ 3Ta/2,\ \ldots,\ Ta(n+½)$$

(where n is an integer)

from the time at which the contraction of the piezoelectric vibrator 9 has stopped as shown in FIG. 7 if it is assumed that the natural vibration cycle of the piezoelectric vibrator 9 is Ta.

The amplitude of a vibration of the piezoelectric vibrator 9 to which a drive signal has not been applied has a certain range, the vibration being caused by a free vibration after the pressure producing chamber 3 has been expanded and the amplitude not being large enough to jet an ink droplet.

In a recording head whose Helmholtz resonance frequency is 100 kHz or more, it has been verified from experiments that the following range is valid.

$$0.8\times Ta(n+½)\ \text{to}\ 1.2\times Ta(n+\times ½)$$

Further, in a recording head whose Helmholtz resonance frequency ranges from 70 to 100 kHz, it has been verified from experiments that the following range on a larger allowable level is valid.

$$0.7\times Ta(n+½)\ \text{to}\ 1.3\times Ta(n+½)$$

In the present invention, in order to prevent crosstalk reliably, the amplitude of the natural vibration of the piezoelectric vibrator 9 after a pressure producing chamber 3 has been expanded or the amplitude of the natural vibration of the piezoelectric vibrator 9 at the time the pressure producing chamber 3 contracts can be limited by defining the first signal duration Pwc or the third signal duration Pwd in function of the natural vibration Ta of the piezoelectric vibrator 9 similarly to the limiting of the second signal duration Pwh as described above.

Since the amplitude of a vibration large enough to jet an ink droplet from the pressure producing chamber 3 with a piezoelectric vibrator 9, to which a drive signal has not been applied, being caused to vibrate due to the propagation through the fixing board 10 of the natural vibration of a piezoelectric vibrator 9 to which these drive signals have been applied depends on the Helmholtz resonance frequency as described above.

Therefore, it has been verified from experiments that the first signal duration Pwc in the first process in which the ink is sucked by the pressure producing chamber 3 can be set to:

$$0.8\times(n+1)\times Ta \leqq Pwc \leqq 1.2\ (n+1)\times Ta$$

(where n is an integer) for a recording head whose Helmholtz resonance frequency is 100 kHz or more, and to $$0.7\times(n+1)\times Ta \leqq Pwc \leqq 1.3\ (n+1)\times Ta$$

(where n is an integer) for a recording head whose Helmholtz resonance frequency ranges from 70 to 100 kHz.

As a result, the degree of amplification in the amplitude of a vibration of a piezoelectric vibrator 9 to which a drive signal has not been applied, the amplification being brought about by the propagation of the natural vibration caused at the time an ink droplet has been jetted, can be suppressed at a timing at which the amplitude of a vibration of a piezoelectric vibrator 9 to which a drive signal has not been applied, the vibration being brought about by the propagation of the natural vibration of the piezoelectric vibrator 9 caused by the expansion of the pressure producing chamber 3, is not large enough to jet an ink droplet similarly to the above case.

Further, it has been verified from experiments that the third signal duration Pwd for jetting an ink droplet from a pressure producing chamber 3 can be set to:

$$0.8\times(n+1)\times Ta \leqq Pwd \leqq 1.2\ (n+1)\times Ta$$

(where n is an integer) for a recording head whose Helmholtz resonance frequency is 100 kHz or more, and to $$0.7\times(n+1)\times Ta \leqq Pwd \leqq 1.3\ (n+1)\times Ta$$

(where n is an integer) for a recording head whose Helmholtz resonance frequency ranges from 70 to 100 kHz.

As a result, the degree of amplification in the amplitude of a vibration of a piezoelectric vibrator 9 to which a drive signal has not been applied, the vibration being caused and lasting by the propagation of the natural vibration of a piezoelectric vibrator 9 at the time an ink droplet has been jetted, can be suppressed at a timing at which the amplitude of a vibration of the piezoelectric vibrator 9 to which a drive signal has not been applied, the vibration being brought about by the propagation of the natural vibration of the piezoelectric vibrator 9 caused by the expansion of the pressure producing chamber 3, is not large enough to jet an ink droplet similarly to the above case.

Assuming that in the aforementioned drive signal generating circuit 26, the capacitance of the capacitor C is C0; the resistance of the resistor R1 is Rr1; the resistance of the resistor R2 is Rr2; the resistance of the resistor R3 is Rr3; and the base-emitter voltages of the transistors Q2, Q4, Q7 are Vbe2, Vbe4, Vbe7, then the charge current Ic1, the discharge current Id, the charge current Ic2, and the charge time Pwc1, the discharge time Pwd1, and the charge time Pwc2 can be given as follows.

$$Ic1=Vbe2/Rr1$$

$$Id=Vbe4/Rr3$$

$$Pwc=C0\times(VH-VM)\ Ic1$$

$$Pwd=C0\times(VH-VL)/Id$$

Hence, the duration of the first signal and that of the third signal can be adjusted simply by the intermediate potential VM and the resistor R3.

In the aforementioned embodiment, the amplitude of the natural vibration of a piezoelectric vibrator 9 caused by the expansion of the pressure producing chamber 3 is suppressed by setting the intermediate potential VM and by charging the capacitor from the intermediate potential VM to the charged voltage VH, i.e., by charging the capacitor by a voltage V1−V2 so that a displacement of the piezoelectric vibrator 9 at the time of contraction becomes smaller than a displacement thereof at the time of expansion. However, it is apparent that similar advantages can be obtained by applying the same to a drive signal for expanding the pressure producing chamber 3 without using the intermediate potential VM.

While the exemplary recording head in which the pressure producing chamber is expanded by charging and contracted by discharging has been described in the aforementioned embodiment, it is apparent that the present invention can be similarly applied to a recording head in which the pressure producing chamber is expanded by discharging and contracted by charging.

Figure 9:
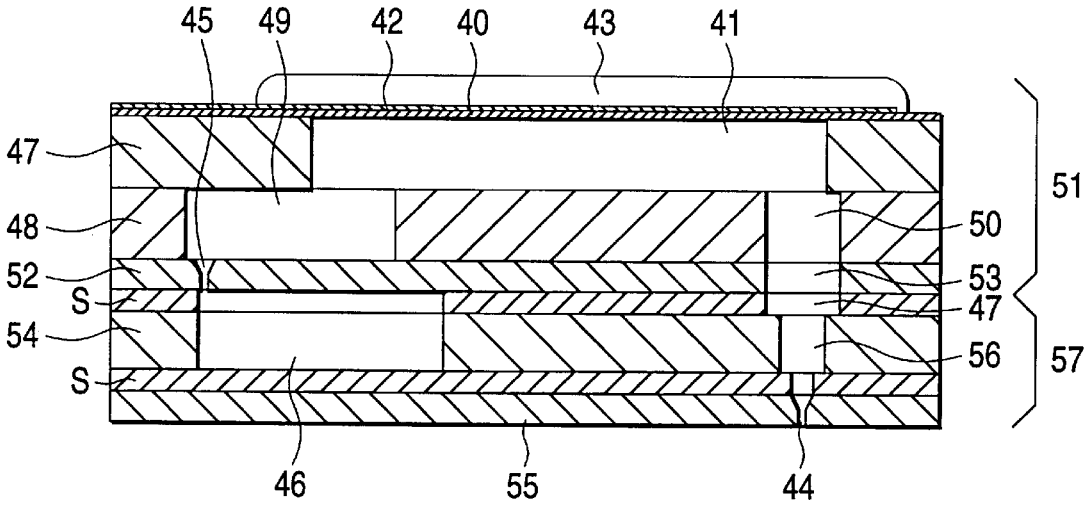
FIG. 9 is a diagram showing another embodiment of a recording head to which the present invention is applicable.
Figure 10:
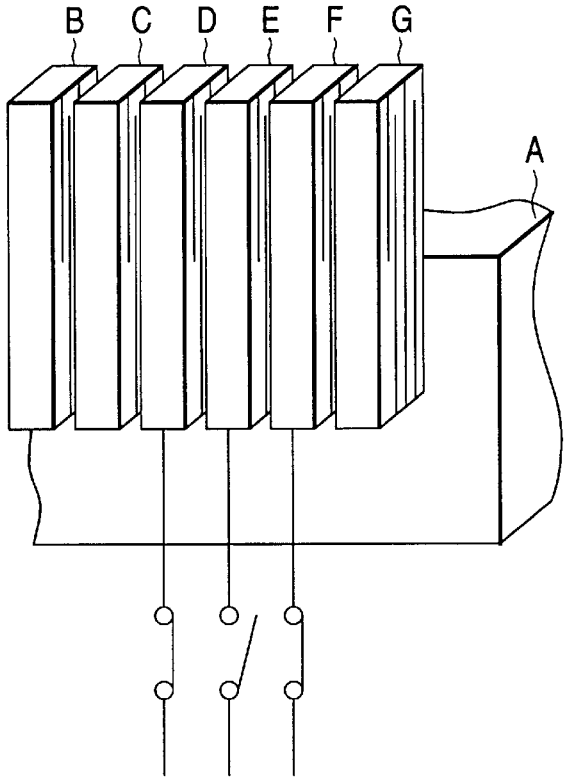
FIG. 10 is a diagram showing an example of a piezoelectric vibrator.
Figure 11:
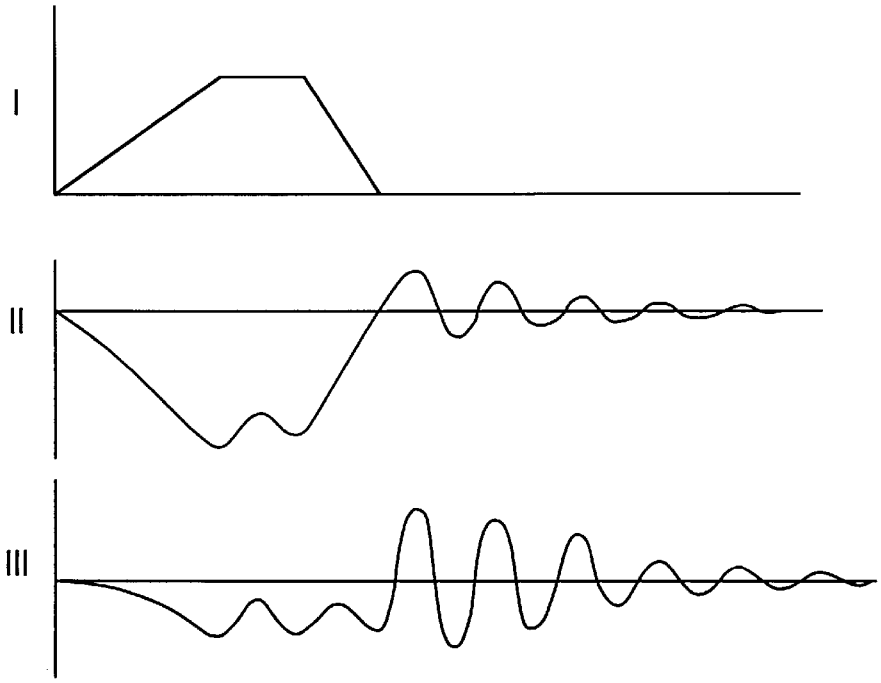
FIG. 11 includes: a waveform diagram (I) showing an example of a drive signal; a diagram (II) showing a displacement of a piezoelectric vibrator to which a drive signal has been applied; a diagram ((III) showing a vibration of a piezoelectric vibrator to which a drive signal has not been applied in enlarged form.

FIG. 9 shows an embodiment of such recording head. In FIG. 9, reference numeral 40 denotes a first cover plate, which is formed of a thin zirconia (ZrO2) plate having a thickness of about 10 μm. On the surface of the first cover plate 40 is a drive electrode 42 that will be described later. The drive electrode 42 is arranged so as to confront a pressure producing chamber 41. On the drive electrode 42 is a piezoelectric vibrator 43 made of PZT or the like.

The pressure producing chamber 41 not only contracts and expands in response to a flexural vibration of the corresponding piezoelectric vibrator 43 so that an ink droplet is jetted out of a corresponding nozzle opening 44, but also sucks ink in a corresponding common ink chamber 46 through a corresponding ink supply port 45.

Reference numeral 47 denotes a spacer. The spacer 47 is formed by boring a through hole in a ceramic plate such as a zirconia plate that is thick enough to form the pressure producing chamber 41, e.g., 150 μm. The aforementioned pressure producing chamber 41 is formed with both surfaces of the spacer 47 sealed by the first cover body 40 and a second cover body 48 that will be described later.

Reference numeral 48 denotes the second cover body, which is formed by boring a through hole 49 connecting the ink supply port 45 to be described later to the pressure producing chambers 41 as well as an ink jetting port 50 for jetting ink in the pressure producing chamber 41 toward the corresponding nozzle opening 44. The second cover body 48 is fixed to the other surface of the spacer 47.

The respective members 40, 47, 48 are assembled into an actuator unit 51 by molding a clay-like ceramic material into predetermined shapes and laminating and sintering the molded shapes one upon another without using an adhesive.

Reference numeral 52 denotes an ink supply port forming board, which also serves as the actuator unit 51 fixing board. The ink supply port forming board 52 is made of metal or ceramic such as rust-preventive copper and the like having ink resistance so that a member for connecting an ink cartridge can also be disposed thereon.

The ink supply port 45 that connects the common ink chamber 46 to be described later to the pressure producing chamber 41 is arranged on one end on the pressure producing chamber 41 side. On the other side of the pressure producing chamber 41 is a through hole 53 that connects the nozzle opening 44 to the ink jetting port 50 of the actuator unit 51.

Reference numeral 54 denotes a common ink chamber forming board, which is formed by boring a through hole corresponding to the shape of the common ink chamber 46 and a communicating hole 56 connecting the nozzle opening 44 of a nozzle plate 55 to the ink jetting port 50 in a plate member such as stainless steel having a thickness large enough to form the common ink chamber 46, e.g., 150 μm The ink supply port forming board 52, the common ink chamber forming board 54, and the nozzle plate 55 are assembled into a passage unit 57 interposing adhesive layers S, S therebetween, each adhesive layer being made of a fusible film or an adhesive.

The recording head is formed by fixing the actuator unit 51 onto the surface of the ink supply port forming board 52 of the passage unit 57 using the adhesive.

As a result of such construction, when a piezoelectric vibrator 43 that has been contracted while charged to a predetermined potential is discharged, the corresponding pressure producing chamber 41 expands, which in turn causes the ink in the corresponding common ink chamber 46 to flow into the pressure producing chamber 41 via the corresponding ink supply port 45. The discharge potential is held for a predetermined time, i.e., until an adjacent piezoelectric vibrator to which a drive signal has not been applied is displaced so as to suck the meniscus toward the corresponding adjacent pressure producing chamber 41, and then the piezoelectric vibrator 43 is charged.

The natural vibration caused on the piezoelectric vibrator 43 at the time the process of expanding and contracting the corresponding pressure producing chamber has been completed propagates to the piezoelectric vibrator 43 to which a drive signal has not been applied similarly to the aforementioned case. Therefore, there is a danger that an ink droplet will be unexpectedly jetted out. However, similarly to the aforementioned embodiment, the possibility of jetting an ink droplet from the pressure producing chamber corresponding to the piezoelectric vibrator to which a drive signal has not been applied can be prevented by adjusting the pressure producing chamber 41 expanding process time, the expansion holding time, or the contraction process time.

Further, while the output timings of the respective signals are controlled by the one-shot multivibrators in the aforementioned embodiment, it is apparent that other types of timing control means such as a microcomputer can be employed.

As described in the foregoing, the present invention is applied to an ink jet recording apparatus that includes: an ink jet recording head having a nozzle opening, a pressure producing chamber communicating with a common ink chamber through an ink supply port and having a Helmholtz resonance frequency, and a piezoelectric vibrator having a natural vibration cycle Ta for expanding and contracting the pressure producing chamber; and drive signal generating means for not only outputting a first signal for expanding the pressure producing chamber, a second signal for keeping the pressure producing chamber expanded, and a third signal for jetting an ink droplet out of the nozzle opening by contracting the expanded pressure producing chamber, but also having a duration Pwh of the second signal set to:

$$0.7\times Ta(n+½)\leqq Pwh\leqq 1.3\times Ta(n+½)$$

when the Helmholtz resonance frequency ranges from 70 to 100 kHz, and to:

$$0.8\times Ta(n+½)\leqq Pwh\leqq 1.2\times Ta(n+½)$$

(where n is an integer)

when the Helmholtz resonance frequency is 100 kHz or more. Therefore, even if a first signal for expanding a pressure producing chamber has been applied and a vibration caused by the expansion has thereafter propagated to an adjacent piezoelectric vibrator to which a drive signal has not been applied, an ink droplet can be jetted out by contracting the pressure producing chamber at such a timing as to induce a vibration whose phase is opposite to that of the vibration caused by the expansion. Therefore, crosstalk caused by the vibration propagating through the fixing board can be prevented.

There is claimed:

1. An ink jet recording apparatus comprising:

an ink jet recording head, having:

a nozzle opening, pressure producing chamber having a Helmholtz resonance frequency and communicating with said nozzle opening, said Helmholtz resonance frequency being at least 70 and less than 100 KHz, an ink supply port communicating with said pressure producing chamber and with a common ink chamber, and a piezoelectric vibrator, which has a natural vibration cycle Ta, for expanding and contracting said pressure producing chamber; and means for generating a drive signal, said drive signal generating means outputting a first signal for expanding said pressure producing chamber, a second signal for keeping said pressure producing chamber expanded, and a third signal for jetting an ink droplet out of said nozzle opening by contracting said expanded pressure producing chamber;

wherein a duration Pwh of said second signal is:

$$0.7\times Ta(n+½)\leqq Pwh\leqq 1.3\times Ta(n+½),$$

where n is an integer.

2. An ink jet recording apparatus according to claim 1, wherein a duration Pwc of said first signal is:

$$0.7\times Ta(n+1)\leqq Pwc\leqq 1.3\times Ta(n+1).$$

3. An ink jet recording apparatus according to claim 1, wherein a duration Pwd of said third signal is:

$$0.7\times Ta(n+1)\leqq Pwd\leqq 1.3\times Ta(n+1).$$

4. An ink jet recording apparatus comprising:

an ink jet recording head, having:

a nozzle opening, a pressure producing chamber having a Helmholtz resonance frequency and communicating with said nozzle opening, said Helmholtz resonance frequency being at least 100 KHz, an ink supply port communicating with said pressure producing chamber and with a common ink chamber, and a piezoelectric vibrator, which has a natural vibration cycle Ta, for expanding and contracting said pressure producing chamber; and means for generating a drive signal, said drive signal generating means outputting a first signal for expanding said pressure producing chamber, a second signal for keeping said pressure producing chamber expanded, and a third signal for jetting an ink droplet out of said nozzle opening by contracting said expanded pressure producing chamber;

wherein a duration Pwh of said second signal is:

$$0.8\times Ta(n+½)\leqq Pwh\leqq 1.2\times Ta(n+½),$$

where n is an integer.

5. An ink jet recording apparatus according to claim 4, wherein a duration Pwc of said first signal is:

$$0.8\times Ta(n+1)\leqq Pwc\leqq 1.2\times Ta(n+1).$$

6. An ink jet recording apparatus according to claim 4, wherein a duration Pwd of said third signal is:

$$0.8\times Ta(n+1)\leqq Pwd\leqq 1.2\times Ta(n+1).$$

7. A method of making an ink jet recording apparatus, comprising:

providing an ink jet recording head, having:

a nozzle opening, a pressure producing chamber having a Helmholtz resonance frequency and communicating with said nozzle opening, an ink supply port communicating with said pressure producing chamber and with a common ink chamber, and a piezoelectric vibrator, which has a natural vibration cycle Ta, for expanding and contracting said pressure producing chamber; and providing means for generating a drive signal, said drive signal generating means outputting a first signal for expanding said pressure producing chamber, a second signal for keeping said pressure producing chamber expanded, and a third signal for jetting an ink droplet out of said nozzle opening by contracting said expanded pressure producing chamber;

when said Helmholtz resonance frequency is at least 70 and less than 100 KHz, setting a duration Pwh of said second signal to:

$$0.7\times Ta(n+½)\leqq Pwh\leqq 1.3\times Ta(n+½),$$

where n is an integer; and when said Helmholtz resonance frequency is at least 100 Khz, setting said duration Pwh to:

$$0.8\times Ta(n+½)\leqq Pwh\leqq 1.2\times Ta(n+½).$$

8. The method of making an ink jet recording apparatus according to claim 7, further comprising:

when said Helmholtz resonance frequency is at least 70 and less than 100 KHz, setting a duration Pwc of said first signal to:

$$0.7\times \mathrm{Ta(n+1)}\leqq \mathrm{Pwc}\leqq 1.3\times \mathrm{Ta(n+1)};$$

when said Helmholtz resonance frequency is at least 100 Khz, setting said duration Pwc to:

$$0.8\times Ta(n+1)\leqq Pwc\leqq 1.2\times Ta(n+1).$$

9. The method of making an ink jet recording apparatus according to claim 7, further comprising:

when said Helmholtz resonance frequency is at least 70 and less than 100 KHz, setting a duration Pwd of said third signal to:

$$0.7\times Ta(n+1)\leqq Pwd\leqq 1.3\times Ta(n+1);$$

when said Helmholtz resonance frequency is at least 100 Khz, setting said duration Pwd to:

$$0.8\times Ta(n+1)\leqq Pwd\leqq 1.2\times Ta(n+1).$$

10. A method of driving ink jet recording apparatus, said ink jet recording apparatus having an ink jet recording head with a nozzle opening, a pressure producing chamber having a Helmholtz resonance frequency and communicating with said nozzle opening, an ink supply port communicating with said pressure producing chamber and with a common ink chamber, a piezoelectric vibrator which has a natural vibration cycle Ta for expanding and contracting said pressure producing chamber, and means for generating a drive signal, said method comprising:

outputting, from said drive signal generation means to said piezoelectric vibrator, a first signal for expanding said pressure producing chamber;

outputting, from said drive signal generation means to said piezoelectric vibrator, a second signal for keeping said pressure producing chamber expanded, wherein:

when said Helmholtz resonance frequency is at least 70 and less than 100 KHz, a duration Pwh of said second signal is:

$$0.7\times Ta(n+½)\leqq Pwh\leqq 1.3\times Ta(n+½),$$

where n is an integer; and when said Helmholtz resonance frequency is at least 100 Khz, said duration Pwh is:

$$0.8\times Ta(n+½)\leqq Pwh\leqq 1.2\times Ta(n+½);$$

outputting, from said drive signal generation means to said piezoelectric vibrator, a third signal for jetting an ink droplet out of said nozzle opening by contracting said expanded pressure producing chamber.

11. The method of driving an ink jet recording apparatus according to claim 10, wherein:

when said Helmholtz resonance frequency is at least 70 and less than 100 KHz, a duration Pwc of said first signal satisfies:

$$0.7\times Ta(n+1)\leqq Pwc\leqq 1.3\times Ta(n+1);$$

when said Helmholtz resonance frequency is at least 100 Khz, said duration Pwc satisfies:

$$0.8\times Ta(n+1)\leqq Pwc\leqq 1.2\times Ta(n+1).$$

12. The method of driving an ink jet recording apparatus according to claim 10 wherein:

when said Helmholtz resonance frequency is at least 70 and less than 100 KHz, a duration Pwd of said third signal satisfies:

$$0.7\times Ta(n+1)\leqq Pwd\leqq 1.3\times Ta(n+1);$$

when said Helmholtz resonance frequency is at least 100 Khz, said duration Pwd satisfies:

$$0.8\times Ta(n+1)\leqq Pwd\leqq 1.2\times Ta(n+1).$$

13. A method of driving ink jet recording apparatus, said ink jet recording apparatus having an ink jet recording head with a plurality of nozzle openings, a plurality of pressure producing chambers, each communicating with a respective one of said plurality of nozzle openings, ink supply ports each communicating with a corresponding one of said plurality of pressure producing chambers and with a common ink chamber, and a plurality of piezoelectric vibrators fixed to a common fixing board, for expanding and contracting corresponding ones of said plurality of pressure producing chambers, said method comprising:

charging a desired piezoelectric vibrator to a first predetermined charge level so that a corresponding desired pressure producing chamber expands, said desired piezoelectric vibrator having an undesired adjacent piezoelectric vibrator, said desired pressure producing chamber having an undesired adjacent pressure producing chamber; then holding said desired piezoelectric vibrator at said first predetermined charge level, first natural vibrations being communicated to said undesired adjacent piezoelectric vibrator through said fixing board; then discharging said desired piezoelectric vibrator so that said desired pressure producing chamber contracts and ejects an ink droplet from said nozzle opening, second natural vibrations being communicated to said undesired adjacent piezoelectric vibrator through said fixing board;

wherein said discharging step is performed so that a cycle of vibration of said second natural vibrations is shifted, with respect to a cycle of vibration of said first natural vibrations, by substantially half of a cycle.

* * * * *

UNITED STATES PATENT AND TRADEMARK OFFICE

CERTIFICATE OF CORRECTION

PATENT NO. : 6,092,886
DATED : July 25, 2000
INVENTOR(S) : Satoru Hosono

It is certified that error appears in the above-identified patent and that said Letters Patent is hereby corrected as shown below:

Column 6,
Line 18, please correct the formula to read as follows:

$$-- \mathrm{FH} = \tfrac{1}{2}\pi \times \sqrt{\{(Mn + Ms)/(Ci + Cv)(Mn \times Ms)\}} --$$

Signed and Sealed this

Ninth Day of April, 2002

*Attest:*

*Attesting Officer*

JAMES E. ROGAN
*Director of the United States Patent and Trademark Office*